US006805425B2

(12) United States Patent
Hayashi et al.

(10) Patent No.: US 6,805,425 B2
(45) Date of Patent: Oct. 19, 2004

(54) IMAGE FORMING DEVICE

(75) Inventors: Shigeyuki Hayashi, Gifu-ken (JP); Masatoshi Kokubo, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/339,559

(22) Filed: Jan. 10, 2003

(65) Prior Publication Data

US 2003/0156150 A1 Aug. 21, 2003

(30) Foreign Application Priority Data

Jan. 11, 2002 (JP) ..... 2002-004732

(51) Int. Cl.[7] ..... B65H 7/02
(52) U.S. Cl. ..... 347/16; 271/265.01; 400/582
(58) Field of Search ..... 271/265.01; 347/14, 347/16, 19; 400/582, 708

(56) References Cited

U.S. PATENT DOCUMENTS 4,794,384 A 12/1988 Jackson ..... 345/166
5,061,946 A * 10/1991 Helmbold et al. ..... 347/218
6,220,686 B1 4/2001 Ludi et al. ..... 347/4
6,599,042 B2 * 7/2003 Wolf ..... 400/582

FOREIGN PATENT DOCUMENTS

JP A 5-307437 11/1993

* cited by examiner

*Primary Examiner*—Lamson Nguyen
*Assistant Examiner*—Blaise Mouttet
(74) *Attorney, Agent, or Firm*—Oliff & Berridge, PLC

(57) ABSTRACT

An image forming device capable of reducing transfer errors of paper even when the transfer amount of paper cannot be detected accurately. The image forming device is provided with a motion sensor, and calculates the transfer amount of paper using signals output by the motion sensor. It is determined whether or not the transfer amount is within a predetermined normal range. If it is determined that the transfer amount is within the normal range, a paper transfer amount control value is set to the calculated transfer amount, while if it is determined that the transfer amount is outside the range, the paper transfer amount control value is set to a preliminarily set standard transfer amount. The image forming device controls the transfer of paper based on the above paper transfer amount control value.

30 Claims, 11 Drawing Sheets

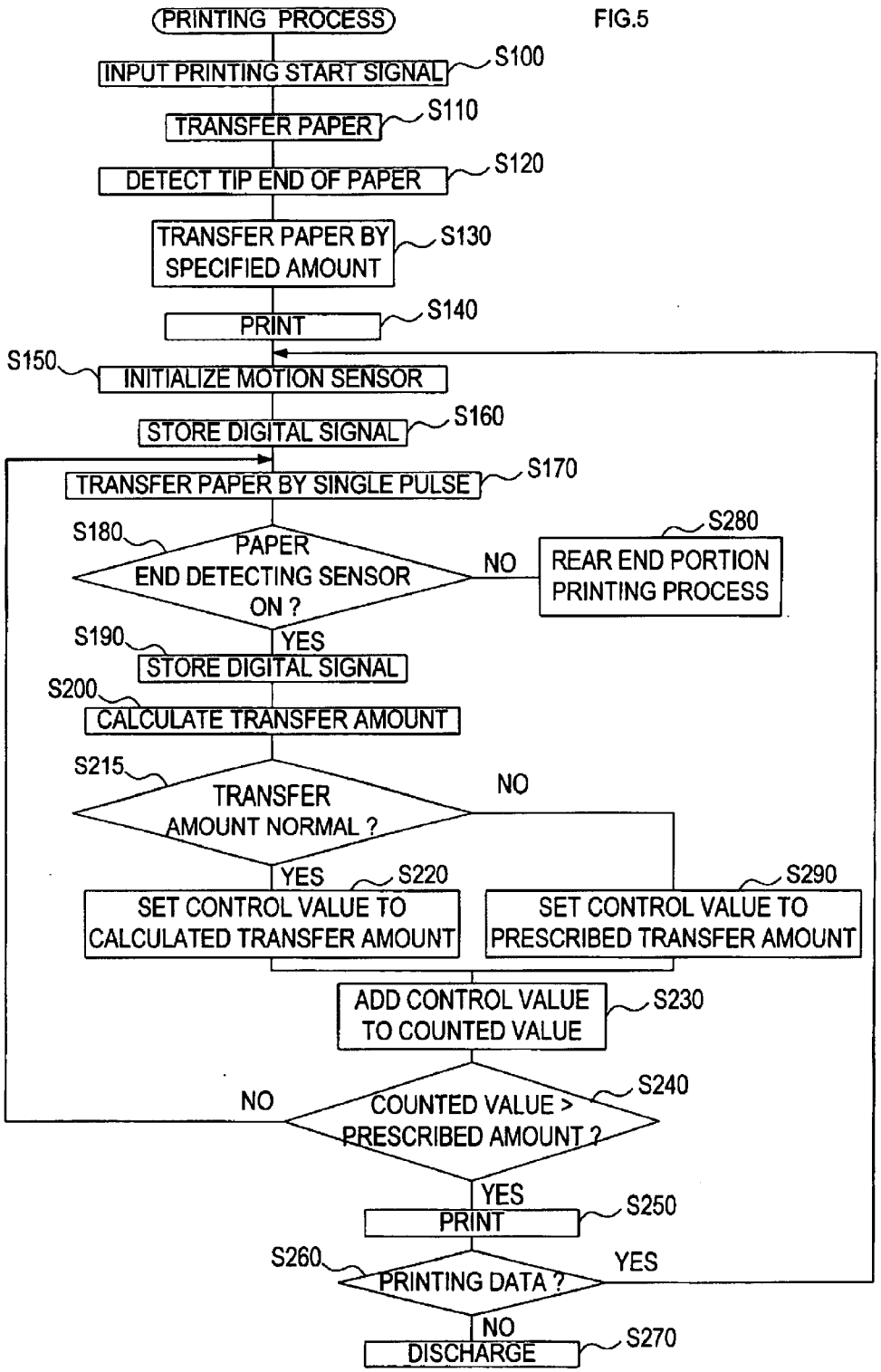
PRINTING PROCESS
FIG.5
INPUT PRINTING START SIGNAL
S100
TRANSFER PAPER
S110
DETECT TIP END OF PAPER
S120
TRANSFER PAPER BY SPECIFIED AMOUNT
S130
PRINT
S140
S150
INITIALIZE MOTION SENSOR
STORE DIGITAL SIGNAL
S160
TRANSFER PAPER BY SINGLE PULSE
S170
S180
PAPER END DETECTING SENSOR ON ?
NO
S280
REAR END PORTION PRINTING PROCESS
YES
S190
STORE DIGITAL SIGNAL
S200
CALCULATE TRANSFER AMOUNT
S215
TRANSFER AMOUNT NORMAL ?
NO
YES
S220
SET CONTROL VALUE TO CALCULATED TRANSFER AMOUNT
S290
SET CONTROL VALUE TO PRESCRIBED TRANSFER AMOUNT
ADD CONTROL VALUE TO COUNTED VALUE
S230
S240
NO
COUNTED VALUE > PRESCRIBED AMOUNT ?
YES
PRINT
S250
S260
PRINTING DATA ?
YES
NO
DISCHARGE
S270

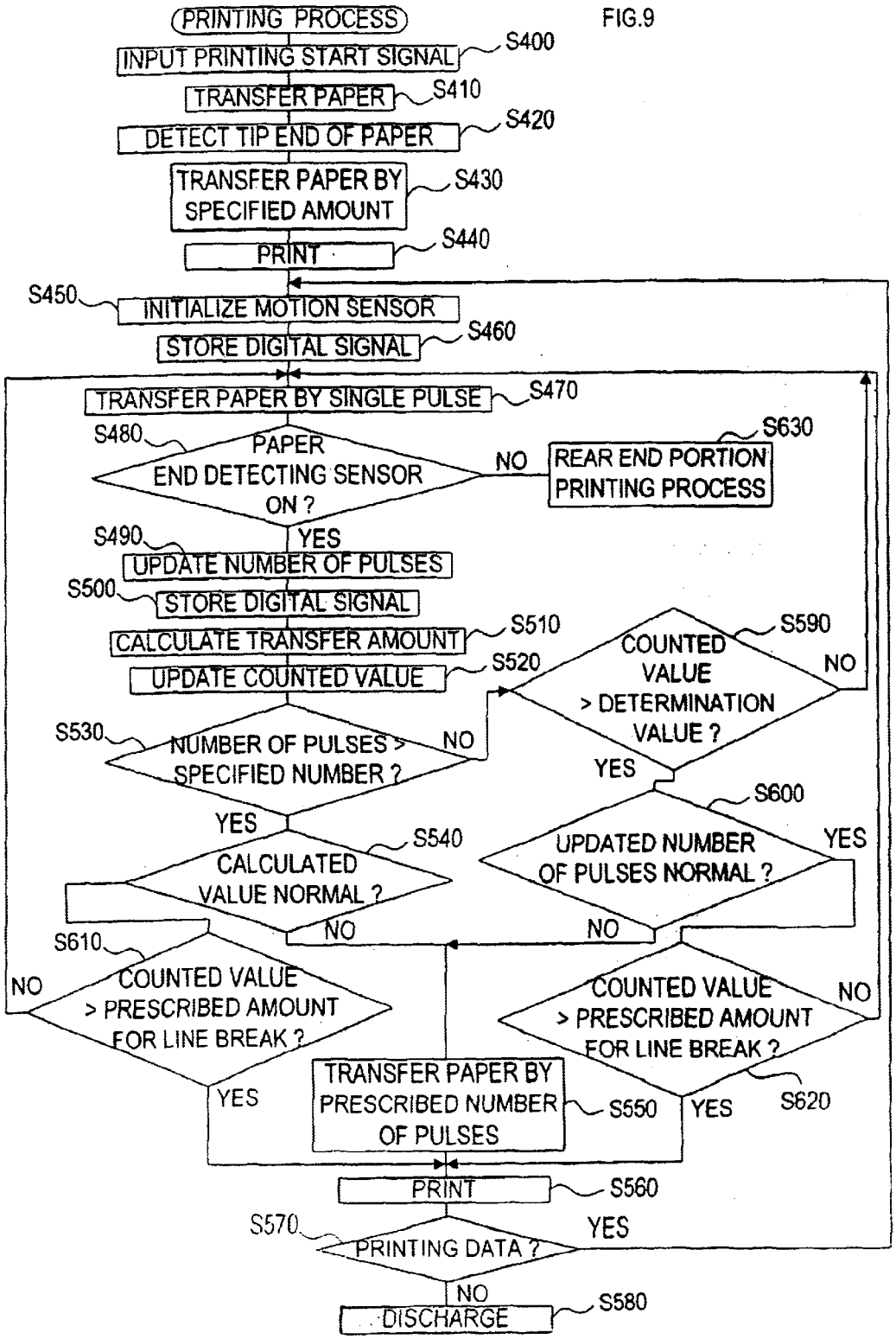
FIG.9
PRINTING PROCESS
INPUT PRINTING START SIGNAL
S400
TRANSFER PAPER
S410
DETECT TIP END OF PAPER
S420
TRANSFER PAPER BY SPECIFIED AMOUNT
S430
PRINT
S440
S450
INITIALIZE MOTION SENSOR
STORE DIGITAL SIGNAL
S460
TRANSFER PAPER BY SINGLE PULSE
S470
S480
PAPER END DETECTING SENSOR ON ?
NO
REAR END PORTION PRINTING PROCESS
S630
YES
S490
UPDATE NUMBER OF PULSES
S500
STORE DIGITAL SIGNAL
CALCULATE TRANSFER AMOUNT
S510
UPDATE COUNTED VALUE
S520
S590
COUNTED VALUE > DETERMINATION VALUE ?
NO
YES
S530
NUMBER OF PULSES > SPECIFIED NUMBER ?
NO
YES
S600
UPDATED NUMBER OF PULSES NORMAL ?
YES
S540
CALCULATED VALUE NORMAL ?
NO
NO
S610
NO
COUNTED VALUE > PRESCRIBED AMOUNT FOR LINE BREAK ?
COUNTED VALUE > PRESCRIBED AMOUNT FOR LINE BREAK ?
NO
YES
TRANSFER PAPER BY PRESCRIBED NUMBER OF PULSES
S550
YES
S620
PRINT
S560
S570
PRINTING DATA ?
YES
NO
DISCHARGE
S580

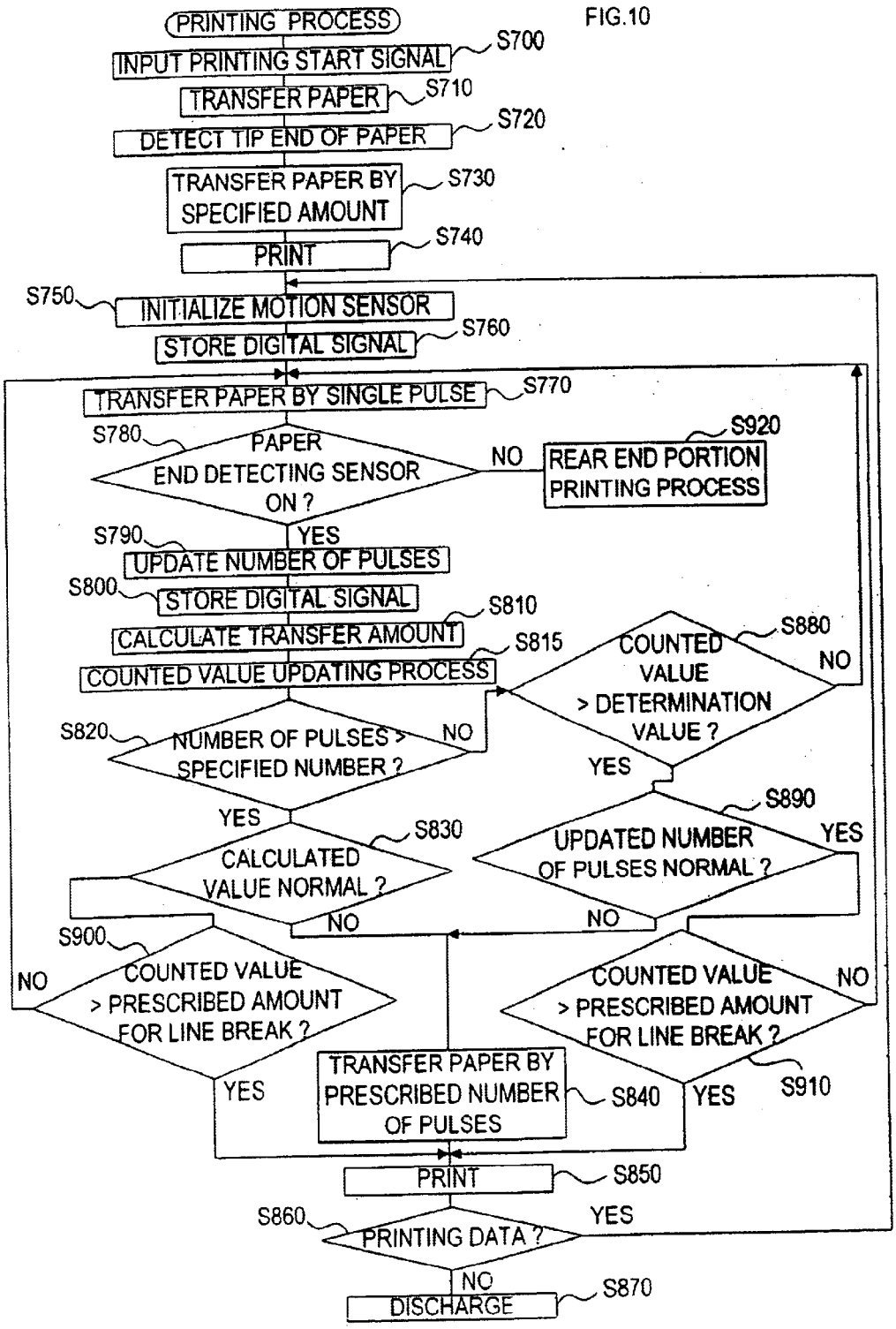
FIG.10
PRINTING PROCESS
INPUT PRINTING START SIGNAL
S700
TRANSFER PAPER
S710
DETECT TIP END OF PAPER
S720
TRANSFER PAPER BY SPECIFIED AMOUNT
S730
PRINT
S740
S750
INITIALIZE MOTION SENSOR
STORE DIGITAL SIGNAL
S760
TRANSFER PAPER BY SINGLE PULSE
S770
S780
PAPER END DETECTING SENSOR ON ?
NO
S920
REAR END PORTION PRINTING PROCESS
YES
S790
UPDATE NUMBER OF PULSES
S800
STORE DIGITAL SIGNAL
S810
CALCULATE TRANSFER AMOUNT
S815
COUNTED VALUE UPDATING PROCESS
S880
COUNTED VALUE > DETERMINATION VALUE ?
NO
S820
NUMBER OF PULSES > SPECIFIED NUMBER ?
NO
YES
YES
S890
S830
CALCULATED VALUE NORMAL ?
UPDATED NUMBER OF PULSES NORMAL ?
YES
NO
NO
S900
NO
COUNTED VALUE > PRESCRIBED AMOUNT FOR LINE BREAK ?
COUNTED VALUE > PRESCRIBED AMOUNT FOR LINE BREAK ?
NO
YES
TRANSFER PAPER BY PRESCRIBED NUMBER OF PULSES
S840
YES
S910
PRINT
S850
S860
PRINTING DATA ?
YES
NO
DISCHARGE
S870

IMAGE FORMING DEVICE

BACKGROUND OF THE INVENTION

1. Field of the Invention

The present invention relates to an image forming device capable of controlling transfer of paper in a highly accurate manner.

2. Background Art

An image forming device such as a printer was conventionally provided with a stepping motor as a driving source, and a paper transfer mechanism for transmitting rotation of the stepping motor to transfer rollers through gear trains and thereby transferring paper through the transfer rollers.

When a stepping motor is used as a driving source, the amount of transferring paper is controlled by controlling the amount of rotation of the motor using pulse driving.

However, since the transfer amount of paper which is actually transferred cannot be detected by a stepping motor itself, it is only possible to estimate the transfer amount based on the number of driving pulses supplied to the motor and assume that paper has been transferred by the estimated amount.

There are known methods for highly accurately detecting the moving amount of a moving object by irradiating laser light toward the object and detecting speckle patterns appearing in the reflected light. For example, in Publication of Japanese Unexamined Patent Application No. 5-307487, which is incorporated by reference, it is disclosed to detect the moving amount of an object by using speckle patterns generated on the surface of a rotating roller in a mouse. Also, in U.S. Pat. No. 6,220,686, which is incorporated by reference, it is disclosed to perform recording control of a head by using speckle patterns generated on the surface of moving paper. According to these methods for detecting the movement of speckle patterns generated in accordance with the movement of paper, it is possible to detect the moving amount in a highly accurate manner.

However, the contrast of speckle patterns generated in the reflected light from paper may be degraded depending on types or conditions of paper.

For example, it is impossible to obtain speckle patterns with satisfactory contrast when using black paper (paper printed with black color), transparent paper (such as PET film) or paper having a mirror surface.

When the transfer amount of paper is detected by a sensor in the case of a low contrast of speckle patterns, as described above, a detected value is sometimes substantially different from the actual transfer amount, and as a result, controlling the transfer amount of paper using such an inaccurate detected value unnecessarily makes the transfer of paper inaccurate.

The present invention has been made in view of the above points, and it is an object thereof to provide an image forming device capable of reducing transfer errors of paper even when the transfer amount of paper cannot be detected accurately by a sensor.

SUMMARY OF THE INVENTION

The above and other objects are achieved by an image forming device which comprises: paper position signal detecting means for irradiating coherent rays of light onto a surface that moves accompanying transfer of paper and for receiving reflected light of the rays of light to generate paper position signals related to positions of the paper; paper transfer amount calculating means for calculating at each specified unit of driving time, through chronological comparison of the paper position signals, a paper transfer amount corresponding to the distance by which the paper has been transferred during each unit of driving time; paper transferring means for transferring the paper by using a driving source at a specified driving speed at each specified time section; paper transfer amount determining means for determining whether or not the calculated paper transfer amount is within a specified normal range at the each unit of driving time; paper transfer amount control value setting means for setting the calculated paper transfer amount as a paper transfer amount control value for a corresponding unit of driving time when it has been determined by the paper transfer amount determining means that the calculated paper transfer amount is within the normal range and for setting a predetermined standard transfer amount as the paper transfer amount control value for a corresponding unit of driving time when it has been determined that the calculated paper transfer amount is outside of the normal range; and time section setting means for setting the time section on the basis of an accumulated value of the paper transfer amount control values.

In the image forming device of the present invention, the paper is transferred at each specified time section, which is defined based on the paper transfer amount control value.

The paper transfer amount control value is set based on determination by paper transfer amount determining means. Specifically, when the calculated paper transfer amount calculated by the paper transfer amount calculating means is within the normal range, the paper transfer amount control value is set to the calculated paper transfer amount, while when the calculated paper transfer amount is outside of the normal range, the paper transfer amount control value is set to a predetermined standard transfer amount.

Therefore, even if the calculated paper transfer amount is substantially different from the actual paper transfer amount for some reason, the paper transfer amount control value, which is set to the predetermined standard transfer amount, will not be substantially different from the actual paper transfer amount.

Accordingly, a substantial error with respect to the time section which is set based on the paper transfer amount control value is prevented, and thus the image forming device of the present invention can perform paper transfer accurately.

The surface that moves accompanying the transfer of the paper here means, for example, the surface of the paper or the surface of a moving member which moves accompanying the transfer of the paper (e.g. the peripheral surface of a roller which rotates accompanying the transfer of the paper).

The time section here corresponds, for example, to the number of pulses by which a stepping motor is driven in the case of using the stepping motor as the driving source, and to the variation of encoder signal in the case of using a direct current motor with an encoder.

According to another aspect of the present invention, there is provided an image forming device which comprises: paper position signal detecting means for irradiating coherent rays of light onto a surface that moves accompanying transfer of paper and for receiving reflected light of the rays of light to generate paper position signals related to positions of the paper; paper transfer amount calculating means for calculating at each specified unit of driving time, through chronological comparison of the paper position signals, a paper transfer amount corresponding to the distance by which the paper has been transferred during each unit of driving time; paper transferring means for transferring the paper by using a driving source at a specified driving speed at each specified time section; correlation value determining means for determining whether or not a correlation value of the paper position signals, which have been compared for calculating the paper transfer amount by the paper transfer amount calculating means, is equal to or higher than a specified reference correlation value; paper transfer amount control value setting means for setting the calculated paper transfer amount as the paper transfer amount control value for a corresponding unit of driving time when it has been determined by the correlation value determining means that the correlation value is equal to or higher than the reference correlation value and for setting a predetermined standard transfer amount as the paper transfer amount control value for a corresponding unit of driving time when it has been determined that the correlation value is lower than the reference correlation value; and time section setting means for setting a time section on the basis of an accumulated value of the paper transfer amount control values.

In the image forming device of the present invention, the paper is transferred at each specified time section, which is defined based on the paper transfer amount control value.

The paper transfer amount control value is set based on determination by paper transfer amount determining means. Specifically, when it is determined by the correlation value determining means that the correlation value of the paper position signals, which have been compared by the paper transfer amount calculating means, is equal to or higher than a specified reference correlation value, the paper transfer amount control value is set to the calculated paper transfer amount, while when it is determined that the correlation value is lower than the reference correlation value, the paper transfer amount control value is set to a predetermined standard transfer amount.

Therefore, even if correlation between the paper position signals compared by the paper transfer amount calculating means is low for some reason (i.e. reliability of the paper transfer amount calculated by the paper transfer amount calculating means is low), the paper transfer amount control value, which is set based on the standard transfer amount, will not be substantially different from the actual paper transfer amount.

Accordingly, a substantial error with respect to the time section which is set based on the paper transfer amount control value is also prevented, and thus the image forming device of the present invention can perform paper transfer accurately.

The correlation here means the degree of agreement between the waveforms of the paper position signals.

According to a further aspect of the present invention, there is provided an image forming device which comprises: paper position signal detecting means for irradiating coherent rays of light onto a surface that moves accompanying transfer of paper and for receiving reflected light of the rays of light to generate paper position signals related to positions of the paper; paper transfer amount calculating means for calculating at each specified unit of driving time, through chronological comparison of the paper position signals, a paper transfer amount corresponding to the distance by which the paper has been transferred during each unit of driving time; paper transferring means for transferring the paper by using a driving source at a specified driving speed at each specified time section; accumulated transfer amount determining means for determining whether or not the accumulated value of the calculated paper transfer amount from the starting point of the time section is smaller than a specified lower limit distance when the accumulated value of driving times of the driving source from the starting point of the time section has reached a specified determining time; and time section setting means for defining, when it has been determined by the accumulated transfer amount determining means that the accumulated value of the calculated paper transfer amount is smaller than the specified lower limit distance a point of time at which the transfer amount of the paper calculated from the starting point of the time section on the basis that the transfer amount per unit driving time is a predetermined standard transfer amount has reached a prescribed section distance as a terminating point of the time section, otherwise defining a point of time at which the accumulated value of the paper transfer amount control values from the starting point of the time section has reached the prescribed section distance as the terminating point of the time section.

In the image forming device of the present invention, when it is determined that the accumulated value of the calculated paper transfer amount is substantially smaller than the actual paper transfer amount (i.e. when it is determined that the accumulated value of the calculated paper transfer amount from the starting point of the time section is smaller than the specified lower limit distance), the time section is defined based on the predetermined transfer amount instead of the accumulated value of the calculated paper transfer amount.

Therefore, in the image forming device of the present invention, it is possible to define the time section without causing a substantial error even if the accumulated value of the calculated paper transfer amount is inaccurate (i.e. smaller than the actual paper transfer amount).

On the other hand, in the image forming device of the present invention, it is possible to define the time section based on the accumulated value of the calculated paper transfer amount when it is determined that the accumulated value of the calculated paper transfer amount is within a range close to the actual paper transfer amount (i.e. it is determined by the accumulated transfer amount determining means that the accumulated value of the calculated paper transfer amount from the starting point of the time section is equal to or larger than the specified lower limit distance).

According to another aspect of the present invention, there is provided an image forming device which comprises: paper position signal detecting means for irradiating coherent rays of light onto a surface that moves accompanying transfer of paper and for receiving reflected light of the rays of light to generate paper position signals related to positions of the paper; paper transfer amount calculating means for calculating at each specified unit of driving time, through chronological comparison of the paper position signals, a paper transfer amount corresponding to the distance by which the paper has been transferred during each unit of driving time; paper transferring means for transferring the paper by using a driving source at a specified driving speed at each specified time section; accumulated time determining means for determining whether or not an accumulated driving time of the driving source from the starting point of the time section is shorter than a specified lower limit time when the accumulated value of the calculated paper transfer amount from the starting point of the time section has reached a specified determining distance; and time section setting means for defining, when it has been determined by the accumulated time determining means that the accumulated driving time of the driving source is shorter than a specified lower limit time, a point of time at which the transfer amount of the paper calculated from the starting point of the time section on the basis that the transfer amount per unit driving time is a predetermined standard transfer amount has reached a prescribed section distance as the terminating point of the time section, otherwise defining a point of time at which the accumulated value of the calculated paper transfer amount from the starting point of the time section has reached the prescribed section distance as the terminating point of the time section.

In the image forming device of the present invention, when it is determined that the accumulated driving time of the driving source, when the accumulated value of the paper transfer amount control value from the starting point of the time section has reached a specified determining distance, is shorter than a normal range (i.e. shorter than a specified lower limit time), the time section is defined without using the accumulated value of the paper transfer amount control value since the accumulated value of the paper transfer amount control value is considered inaccurate (i.e. larger than the actual value).

Therefore, in the image forming device of the present invention, it is possible to define the time section without causing a substantial error even if the accumulated value of the paper transfer amount control value is inaccurate (i.e. larger than the actual paper transfer amount).

On the other hand, in the image forming device of the present invention, it is possible to define the time section based on the accumulated value of the paper transfer amount control value when it is determined that the accumulated value of the paper transfer amount control value is within a range close to the actual paper transfer amount (i.e. it is determined by the accumulated time determining means that the accumulated driving time of the driving source is equal to or larger than a specified lower limit time).

BRIEF DESCRIPTION OF THE DRAWINGS

Preferred embodiments according to the present invention will now be described with reference to the drawings in which:

FIG. 5 is a flowchart illustrating the printing processes performed by the ink jet printer of Embodiment 1;

FIG. 9 is a flowchart illustrating printing processes performed by the ink jet printer of Embodiment 3;

FIG. 10 is a flowchart illustrating printing processes performed by the ink jet printer of Embodiment 4.

DETAILED DESCRIPTION OF PREFERRED EMBODIMENTS

An image forming device of the present invention will now be explained with reference to Embodiments 1 to 4 taking an ink jet printer for example.

(Embodiment 1)

a) The overall structure of an ink jet printer 1 will now be explained with reference to FIG. 1.

Figure 1:
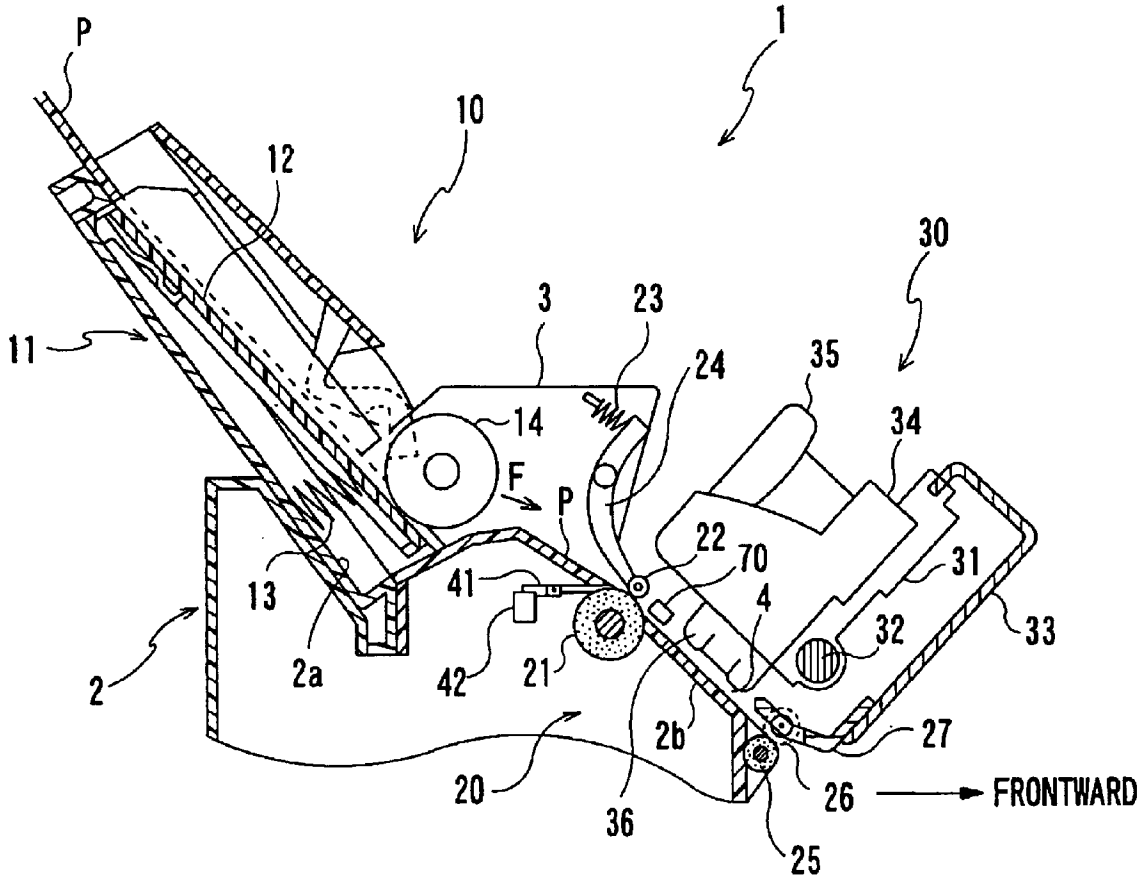
FIG. 1 is a sectional view illustrating the overall structure of an ink jet printer of Embodiment 1.

The ink jet printer 1 comprises a paper feed mechanism 10 capable of accommodating a plurality of sheets of paper P and of supplying the plurality of sheets of paper one by one, a paper transfer mechanism 20 for transferring the paper P that has been supplied by the paper feed mechanism 10 through a paper transfer path 4 to a paper eject table (not shown), a print mechanism 30 for jetting ink onto the paper P during transfer for printing (image forming), a drive mechanism (not shown) for transmitting driving force to rollers included in the paper feed mechanism 10 and the paper transfer mechanism 20, a controller 50 (paper transfer amount calculating means, paper transfer amount determining means, paper transfer amount control value setting means and time section setting means, not illustrated in FIG. 1) for controlling actions of each of the above-listed portions, a motion sensor 70 (paper position signal detecting means) for detecting positional information of paper and outputting such information to the controller 50, and a main body frame 2 for supporting each of the above-listed portions.

b) The structure of the paper feed mechanism 10 will now be explained with reference to FIG. 1.

The paper feed mechanism 10 is comprised with a paper feed cassette 11 that is attached in a freely attachable/detachable manner to a cassette mounting concave 2*a* formed at an upper end of a rear end portion of the main body frame 2.

The paper feed cassette 11 is comprised, on an upper side thereof (upside in FIG. 1.), with a paper table 12 onto which a plurality of sheets of paper P is stacked. A rear end portion (left-hand side in FIG. 1) of the paper table 12 is pivotally supported at a main body of the paper feed cassette 11 in a freely swinging manner while a front end portion (right-hand side in FIG. 1) thereof is biased upwardly by a compression coil spring 13.

Further, the paper feed mechanism 10 is comprised with a laterally extending (in the depth direction in FIG. 1) paper feed roller 14 on an upper side of the front end portion of the paper table 12. Both lateral ends of the paper feed roller 14 are pivotally supported, each in a freely rotating manner, by a pair of right and left side wall plates 3 coupled to the main body frame 2, and the paper feed roller 14 is rotated by the rotating force that is transmitted from a feed motor 62 (not shown in FIG. 1) via the drive mechanism (not shown).

The plurality of sheets of paper P that are stacked on the paper table 12 of the paper feed cassette 11 are pressed against the paper feed roller 14 by the compression coil spring 13 through the paper table 12. Accordingly, when the paper feed roller 14 is rotated by the drive mechanism in a counter-clockwise direction, the uppermost sheet of paper P that contacts the paper feed roller 14 is fed in a paper feeding direction F that is directed to the print mechanism 30 (right-hand side direction in FIG. 1).

c) The structure of the paper transfer mechanism 20 will now be explained with reference to FIGS. 1 to 3.

The paper transfer mechanism 20 is comprised with a paper transfer path 4 for transferring paper P. The paper transfer path 4 comprises a part of the main body frame 2 that extends from the cassette mounting concave 2*a* to a frontward extending paper guide portion 2*b*.

The paper transfer mechanism 20 is further comprised with a rubber-made first transfer roller 21 pivotally supported in a rotating manner in the paper transfer path 4 upstream (left-hand side in FIG. 1) of a printing head 36 of the print mechanism 30 that will be described later. The first transfer roller 21 is driven in a clockwise direction (clockwise direction in FIG. 1) by the driving force transmitted from the drive mechanism. A follower roller 22 abuts the first transfer roller 21 from above. The follower roller 22 is pivotally attached to a lower end portion of a swinging arm 24 in a freely rotating manner. While pivotally attached to the side wall plate 3 at its upper end portion, the swinging arm 24 is pressed and biased in a direction of pressing the follower roller 22 against the first transfer roller 21 by means of a compression coil spring 23.

The paper transfer mechanism 20 is further comprised with a rubber-made second transfer roller 25 pivotally supported by the main body frame 2 in a rotating manner in the paper transfer path 4 downstream of the printing head 36. The second transfer roller 25 is driven in the clockwise direction (clockwise direction in FIG. 1) by the driving force transmitted from the drive mechanism. A plurality of spur rollers 26 abut the second transfer roller 25 from above. The spur rollers 26, each of which is a gear-like roller with a plurality of radial protrusions, are pivotally supported in a freely rotating manner by a mounting plate 27 that is fixedly attached to a supporting plate 33 (to be described later) at specified intervals in the printing width direction (depth direction in FIG. 1).

With the above-described arrangement, paper P that has been fed from the paper feed mechanism 10 is transferred in the paper transfer direction F in accordance with the rotation of the first transfer roller 21 and the second transfer roller 25.

The paper transfer, mechanism 20 is further comprised with a paper end detecting sensor 42 for detecting presence or absence of paper P somewhat upstream of the printing head 36.

Figure 2:
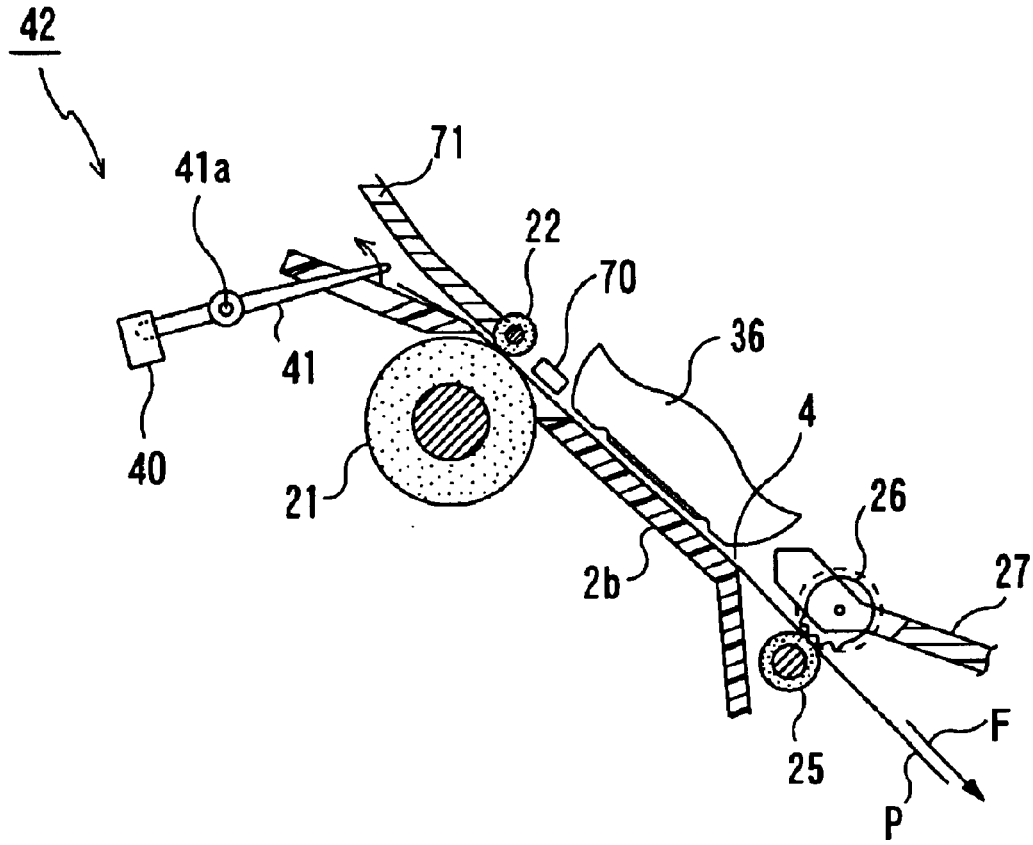
FIG. 2 is a sectional view illustrating the peripheral portion of a paper transfer mechanism of the ink jet printer of Embodiment 1.

As illustrated in FIG. 2, the paper end detecting sensor 42 is provided so as to rotate about axis 41*a*, and is comprised of a rotating portion 41 that is biased in a counter-clockwise direction and a detecting portion 40 that is switched OFF when the rotating portion 41 has rotated in a counter-clockwise direction while it is switched ON when the rotating portion 41 has rotated in a clockwise direction.

Actions of the paper end detecting sensor 42 at the time when paper P passes will be explained hereinafter.

When no paper P is proximate of the printing head 36, the rotating portion 41 is in a condition of having been rotated in a counter-clockwise direction by the biasing force with its tip end (right end in FIG. 2) projecting upward in the paper transfer path 4. At this time, the detecting portion 40 is in the switched-OFF condition.

When the paper P is transferred from upstream and its tip end makes the rotating portion 41 rotate in a clockwise direction, the detecting portion 40 is switched ON.

When the paper P further proceeds so that its rear end passes the rotating portion 41, the rotating portion 41 will again start being rotated in the counter-clockwise direction by the biasing force and the detecting portion 40 is switched OFF.

In other words, the paper end detecting sensor 42 is switched ON in the presence of paper P while it is switched OFF in the absence of paper P so that presence or absence of paper P may be detected.

d) The structure of the print mechanism 30 will now be explained with reference to FIGS. 1 and 2.

The print mechanism 30 is comprised with a guide rod 32 supported by side walls (not illustrated) and extending in the lateral directions (depth direction in FIG. 1), a supporting plate 33 provided frontward of the main body frame 2 (right-hand side in FIG. 1) to project upward, and a carriage 31 supported by the guide rod 32 and an upper end portion of the supporting plate 33 to be movable in the lateral directions.

A cartridge holder 34 is fixed to the carriage 31, and an ink cartridge 35 containing therein ink to be supplied for printing is attached to the cartridge holder 34 in a freely attachable/detachable manner.

The printing head 36 is mounted to the carriage 31 so as to face the paper transfer path 4. A plurality of ink jet nozzles (not shown) for jetting ink supplied from the ink cartridge 35 are formed in the printing head 36. The ink jet nozzles are arranged such that, for instance, 64 nozzles are arranged in a double row, i.e. 32 nozzles in each row.

The carriage 31 may perform reciprocating movements in lateral directions by the driving force transmitted from a carriage drive mechanism (not shown). When printing, selective jet-driving of, for instance, the 64 ink jet nozzles is performed on the basis of dot pattern data to be printed while making the carriage 31 (ink jet nozzles) perform reciprocating movements.

e) The structure of the controller 50 (control portion) will now be explained with reference to FIG. 3.

Figure 3:
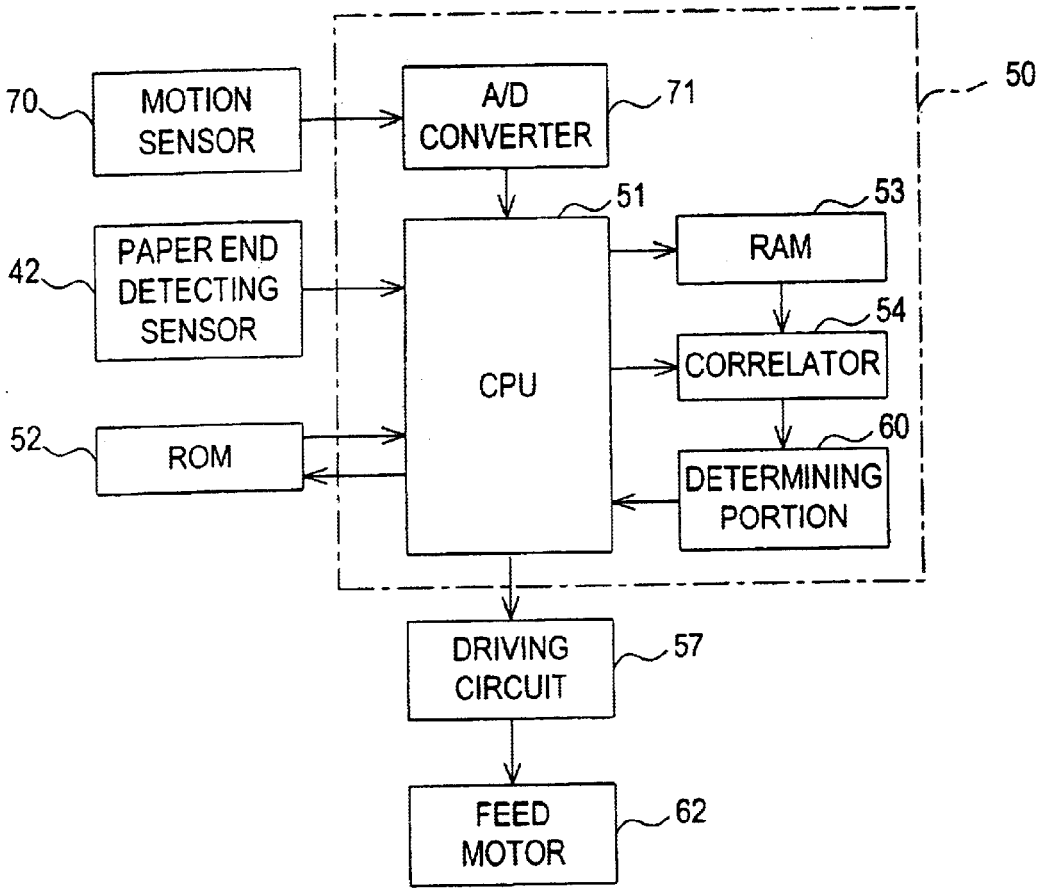
FIG. 3 is a block diagram illustrating the structure of a controller of the ink jet printer of Embodiment 1.

As illustrated in FIG. 3, the controller 50 is comprised with a CPU 51, and a ROM 52, a RAM 53, a correlator 54, a paper driving circuit 57 and a determining portion 60 all connected to the CPU 51.

A motion sensor 70 is further connected to the CPU 51 through an A/D converter 71, and a paper end detecting sensor 42 is connected to the CPU 51 as well.

The paper driving circuit 57 is connected to a feed motor 62 and transmits signals related to driving of the feed motor 62. It should be noted that the feed motor 62 is a stepping motor and is driven at a specified speed in units of a specified pulse time. The feed motor 62 drives the paper feed roller 14 of the paper feed mechanism 10 as well as the first transfer roller 21 and the second transfer roller 25 of the paper transfer mechanism 20.

The controller 50 detects the transfer amount of paper P on the basis of signals transmitted from the motion sensor 70 (paper position signals) or signals transmitted from the paper end detecting sensor 42, and controls the feed motor 62 based on the detected value of the transfer amount. A detailed explanation of the methods will be provided later.

While the controller 50 is capable of performing similar control as controllers within ordinary ink jet printers do, explanations thereof will be omitted here because the present invention does not relate to such control.

f) The structure of the motion sensor 70 will next be explained with reference to FIGS. 1 and 4.

The motion sensor 70 is provided upstream of the print mechanism 30 above the paper transfer path 4 as illustrated in FIG. 1.

Figure 4:
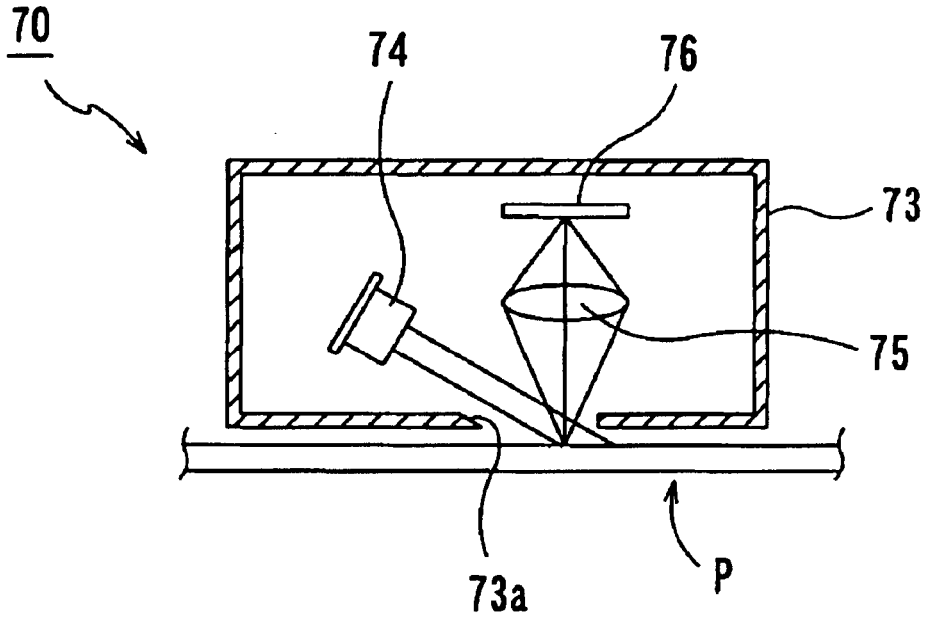
FIG. 4 is a sectional view illustrating the structure of the motion sensor of the ink jet printer of Embodiment 1.

As illustrated in FIG. 4, the motion sensor 70 is provided with a semiconductor laser 74 for irradiating laser light towards the paper P, a lens 75 for focusing the reflected light of the laser light from the paper P, a two-dimensional semiconductor image sensor 76 for receiving the focused reflected light and a sensor housing 73 for containing the above members.

The laser light irradiated from the semiconductor laser 74 passes through an aperture portion 73*a* provided at a lower portion of the housing 73 and is reflected by the surface of the paper P. The reflected light again passing through the aperture portion 73*a* is focused by the lens 75 and made incident into the two-dimensional semiconductor image sensor 76. The two-dimensional semiconductor image sensor 76 is provided with a light-receiving portion in which, for example, pixels of approximately 5 $\mu$m are arranged in orders of 400 by 400, and performs photoelectric conversion of the reflected light for generating image signals. The image signals are sent to the A/D converter 71 through a not illustrated amplifier and are converted into digital signals.

Spot-like interference patterns that are referred to as speckles (speckle patterns) are generated in the reflected light from the paper P that are illustrative of the surface shape of the paper P at points the laser light is reflected. Such speckle patterns are also generated in digital signals, which are image signals of the reflected light. Detailed explanation of paper transfer control using such digital signals will be provided later.

g) Actions of the ink jet printer 1 will now be explained with reference to FIGS. 5 to 7.

In Step 100, a printing start signal and printing data are input from a not illustrated external electronic device through an interface for communication into the controller 50 and are stored in the RAM 53.

In Step 110, the paper P is taken out from the paper feed cassette 11 and is transferred along the transfer path 4.

More particularly, the driving circuit 57 of the controller 50 generates a driving signal and send it to the feed motor 62. The driving force of the feed motor 62 is transmitted to the paper feed roller 14 of the paper feed mechanism 10 through the driving mechanism. The driven paper feed roller 14 takes out the paper P one by one from the paper feed cassette 11 and feeds the sheet to the transfer path 4.

When a tip end of the paper P is detected by the paper end detecting sensor 42 in Step 120, the paper feed roller 14 further rotates by a specified amount in Step 130 so that the tip end of the paper P hits against a nip of the first transfer roller 21 and the follower roller 22 to cause so-called resist actions; thereafter, upon rotational driving of the feed motor 62 in a reverse direction, the first transfer roller 21, which has so far been rotating in a counter-clockwise direction in FIGS. 1 and 2 starts to rotate in a clockwise direction by a specified amount (prescribed amount for tip end) to transfer the paper P until a top of a printing region of the paper P is placed right under the printing head 36 of the print mechanism 30. Thereafter, the first transfer roller 21 and the paper P temporarily stop.

It should be noted that since no driving force of the feed motor 62 is transmitted to the paper feed roller 14 when the first transfer roller 21 is rotationally driven in a clockwise direction by the feed motor 62, no hindrance will be caused in the transfer of paper P accompanying the rotation of the first transfer roller 21.

In Step 140, printing of the printing data corresponding to the first line is performed by using the print mechanism 30 with the paper P in a suspended condition.

In Step 150, the motion sensor 70 is initialized and the counted value stored in the RAM 53 is reset as a preparation for executing a process to be discussed later (i.e. a process of determining whether the counted value since the Step 150 has reached a prescribed amount for line break). The counted value, which is a parameter that is counted up on the basis of signals output from the motion sensor 70, will be described in detail later.

In Step 160, a digital signal detected by the motion sensor 70 is stored in the RAM 53 (execution of paper position signal detecting means).

More particularly, a laser light from the semiconductor laser 74 is irradiated onto the paper P and the reflected light thereof is detected by the two-dimensional semiconductor image sensor 76. The two-dimensional semiconductor image sensor 76 performs photoelectric conversion of the reflected light for generating an image signal. The image signal is amplified in the amplifier, further converted into a digital signal in the A/D converting circuit 71 and stored in the RAM 53.

Since the laser light has coherency, the reflected light that is received by the two-dimensional semiconductor image sensor 76 includes speckle patterns illustrative of the surface shape of the paper P at the point the laser light has been reflected, and the digital signal that is obtained by performing photoelectric conversion of the reflected light also includes speckle patterns.

In Step 170, the paper P is transferred in the downstream direction by driving the feed motor 62 by a single pulse.

In Step 180, it is determined whether the, paper end detecting sensor 42 is ON or not (that is, whether the rear end of the paper P in the transferring direction has not yet passed the paper end detecting sensor 42 or already has), and the program proceeds to Step 190 when YES. On the other hand, when NO, the program proceeds to Step 280.

In Step 190, a digital signal detected by the motion sensor 70 is stored in the RAM 53, similarly to the above Step 160 (execution of the paper position signal detecting means).

The digital signal includes speckle patterns illustrative of the surface shape of the paper P at points laser light has been reflected.

In Step 200, the newest signal and the next newest signal among the digital signals that have been stored in the RAM 53 either in Step 160 or in Step 190 are used for performing calculation in the correlator 54 and the transfer amount by which the paper P has been transferred in the transferring direction in Step 170 is calculated (execution of paper transfer amount calculating means).

Detailed explanation will now be made with reference to FIG. 6.

The digital signal stored in the RAM 53 in Step 160 or Step 190 respectively includes speckle patterns illustrative of the surface shapes at the points the laser light has been reflected (surface of the paper P).

When the paper P is transferred, the points at which the laser light is reflected will be shifted, and speckle patterns in the digital signals will be moved by an amount corresponding to the transfer amount of the paper P.

In other words, the speckle patterns prior to transfer of the paper P will be moved to the speckle patterns after transfer of the paper P by an amount corresponding to the transfer amount of the paper P.

Accordingly, the transfer amount of the paper P can be calculated on the basis of measured results obtained by measuring the moving amount of the speckle patterns accompanying the transfer of the paper P.

Figure 6:
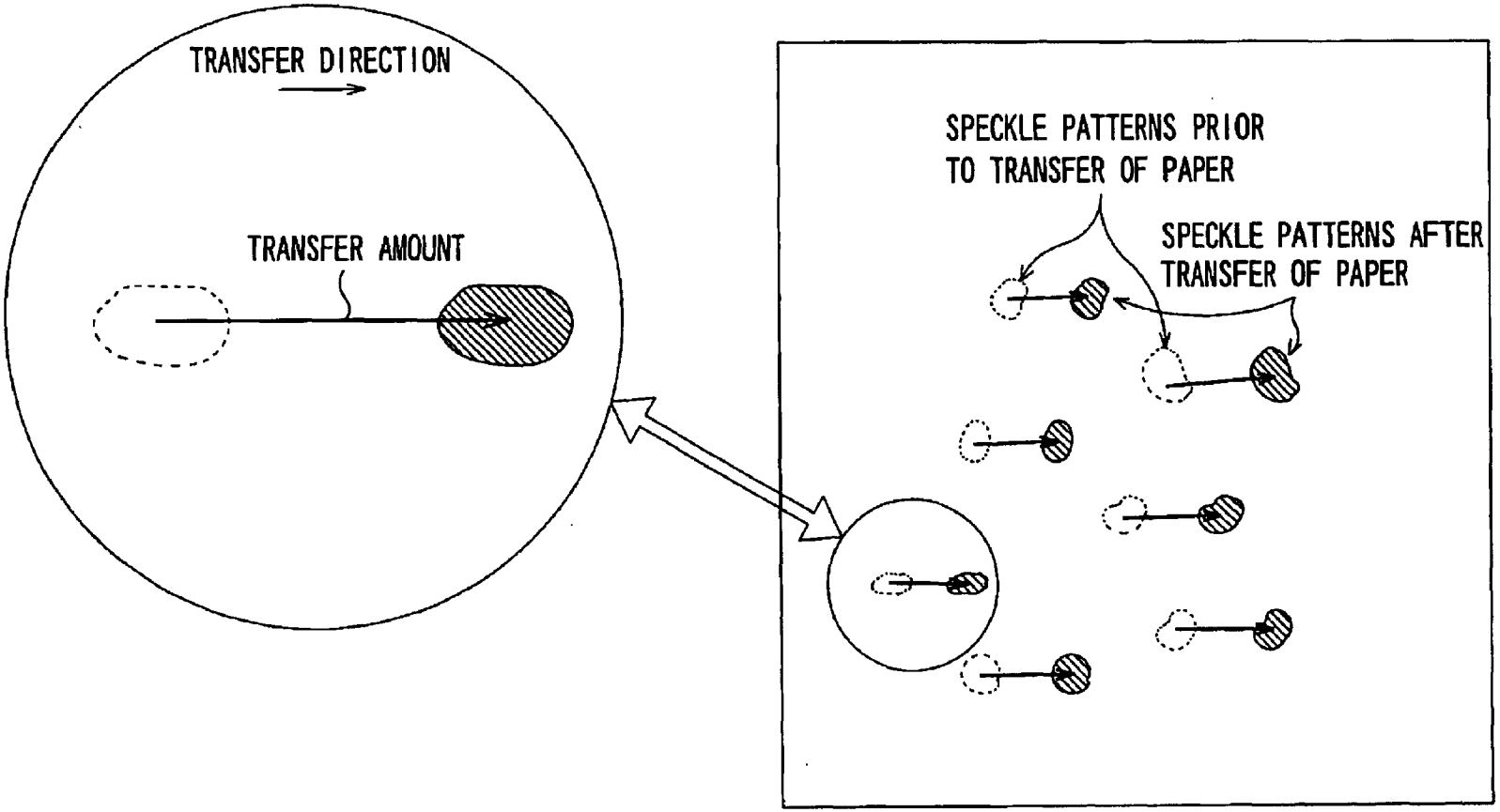
FIG. 6 is an explanatory view illustrating a method for detecting the transfer amount of paper during the printing processes performed by the ink jet printer of Embodiment 1.
Figure 7:
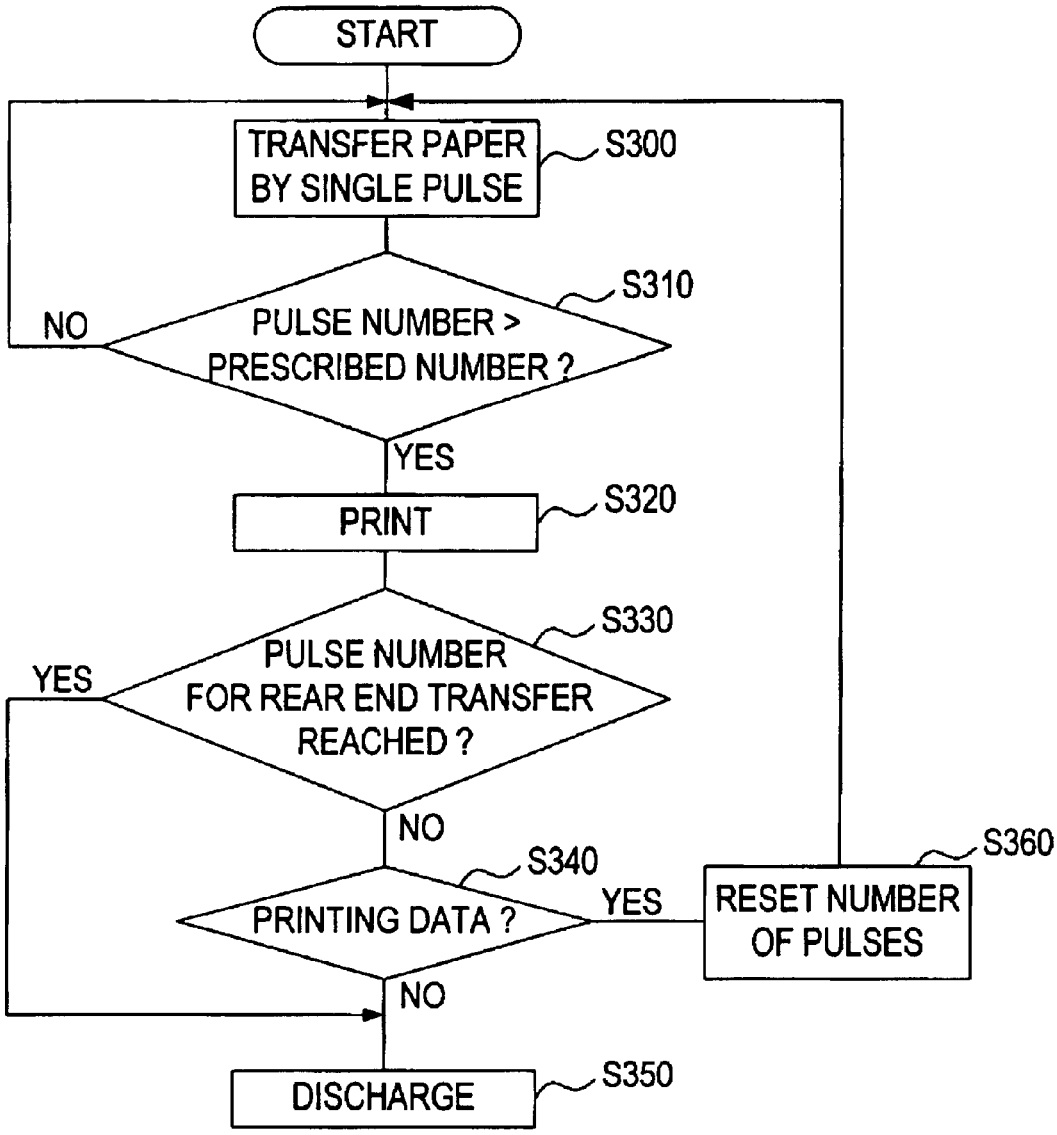
FIG. 7 is a flowchart illustrating rear end portion printing processes performed by the ink jet printer of Embodiment 1.

Thus, in this Step 200, speckle patterns of the respective digital signals stored in the RAM 53 prior to and after the transfer of the paper P (Step 170) are first compared in the correlator 54 as illustrated in FIG. 6 for determining the moving amount of the speckle patterns. Then, the transfer amount of the paper P in Step 170 is calculated in the CPU 51 on the basis of the results of the determination. The transfer amount of the paper P is stored in the RAM 53.

In Step 215, it is determined whether or not the transfer amount of the paper P as calculated in Step 200 is within a specified normal range (execution of paper transfer amount determining means).

Specifically, the transfer amount of the paper P as calculated in Step 200 is compared in the CPU 51 with data of the normal range which are preliminarily stored in the ROM 52 of the controller 50.

Here, an acceptable fluctuation of the transfer amount for a single pulse from the theoretical transfer amount is defined as ±10% and the transfer amount is determined as normal when it is within the above fluctuation range. Alternatively, it may be possible to define a fluctuation range of the transfer amount for a specified number of pulses (e.g. 10 pulses) from the corresponding theoretical transfer amount. When the deviation of the transfer amount from the theoretical transfer amount due to dimensional tolerance of parts is given by, for example, measurement, it may further be possible to define an acceptable fluctuation range on the basis of a transfer amount in view of the deviation instead of the theoretical transfer amount.

When it is determined that it is within the normal range, the program proceeds to Step 220 while it proceeds to Step 290 when it is determined that it is outside of the normal range.

In Step 220, a paper transfer amount control value is set to the transfer amount of the paper P as calculated in Step 200 and is stored in the RAM 53 (execution of paper transfer amount control value setting means).

In Step 230, the paper transfer amount control value as calculated in Step 220 is added to the counted value, which is a parameter stored in the RAM 53 (an accumulated value of the paper transfer amount control value at the time the Step 230 was executed the last time), for updating the counted value. It should be noted the counted value is a value that is reset in Step 150 as already described.

In Step 240, it is determined by using the correlator 54 whether or not the counted value updated in Step 230 has reached a prescribed amount for line break (the length of the nozzle portions of the printing head 36: for instance, 1 inch)(i.e. whether or not a terminating point of a time section has been reached). The prescribed amount for line break is preliminarily stored in the ROM 52 as data. When the counted value has reached the prescribed amount for line break, the program proceeds to Step 250, while when the counted value has not reached the prescribed amount for line break yet, the program proceeds to Step 170.

In Step 250, printing corresponding to a single line is performed. It is the head portion of the printing data which have not been printed yet that is to be printed in this Step 250.

In Step 260, it is determined whether any printing data which have not been printed yet are present or not. If YES, the program proceeds to Step 150, while it proceeds to Step 270 if NO.

In Step 270, the first transfer roller 21 and the second transfer roller 26 are driven by the feed motor 62 for discharging the paper P to the downstream side of the transfer path 4.

On the other hand, when it is determined NO in Step 215, the program proceeds to Step 290. In Step 290, the paper transfer amount control value is set to a prescribed transfer amount, and the program proceeds to Step 230 (execution of paper transfer amount control value setting means).

When it is determined NO in Step 180, the program proceeds to Step 280 for executing rear end portion printing processes. Rear end portion printing processes will now be explained with reference to FIG. 7.

In Step 300, the paper P is transferred in the downstream direction by driving the feed motor 62 for a single pulse time In Step 310, it is determined whether or not the number of pulses has reached a prescribed number of pulses. If it is determined YES, the program proceeds to Step 320, while if it is determined NO, the program proceeds to Step 300.

In Step 320, printing of a single line is executed. It is the head portion of the printing data which have not been printed yet that is printed in this Step 320.

In Step 330, it is determined whether or not the number of times the above Step 300 has been executed since the paper end detecting sensor 42 was switched off (i.e. it was determined NO in Step 180) has reached a specified number of pulses for rear end transfer (that is, whether or not printing has been completed up to the rear end of the paper P). If NO, the program proceeds to Step 340, while if YES, it proceeds to Step 350.

In Step 340, it is determined whether any printing data that have not been printed yet are present or not. If NO, the program proceeds to Step 350, while if YES, it proceeds to Step 360.

In Step 350 the first transfer roller 21 and the second transfer roller 25 are driven by the feed motor 62 for discharging the paper P to the downstream side of the transfer path 4.

On the other hand, when it is determined YES in Step 340, the program proceeds to Step 360. In this Step 360, the number of pulses stored in the RAM 53 is reset and the program proceeds to Step 300.

With the above arrangement, transfer of the paper P is to be controlled on the basis of the prescribed number of pulses (number of reference pulses required for line break) after the rear end of the paper P has passed the paper end detecting sensor 42, so that no inconveniences will be caused in printing even if the rear end of the paper P should pass through the motion sensor 70 thereafter.

Figure 8:
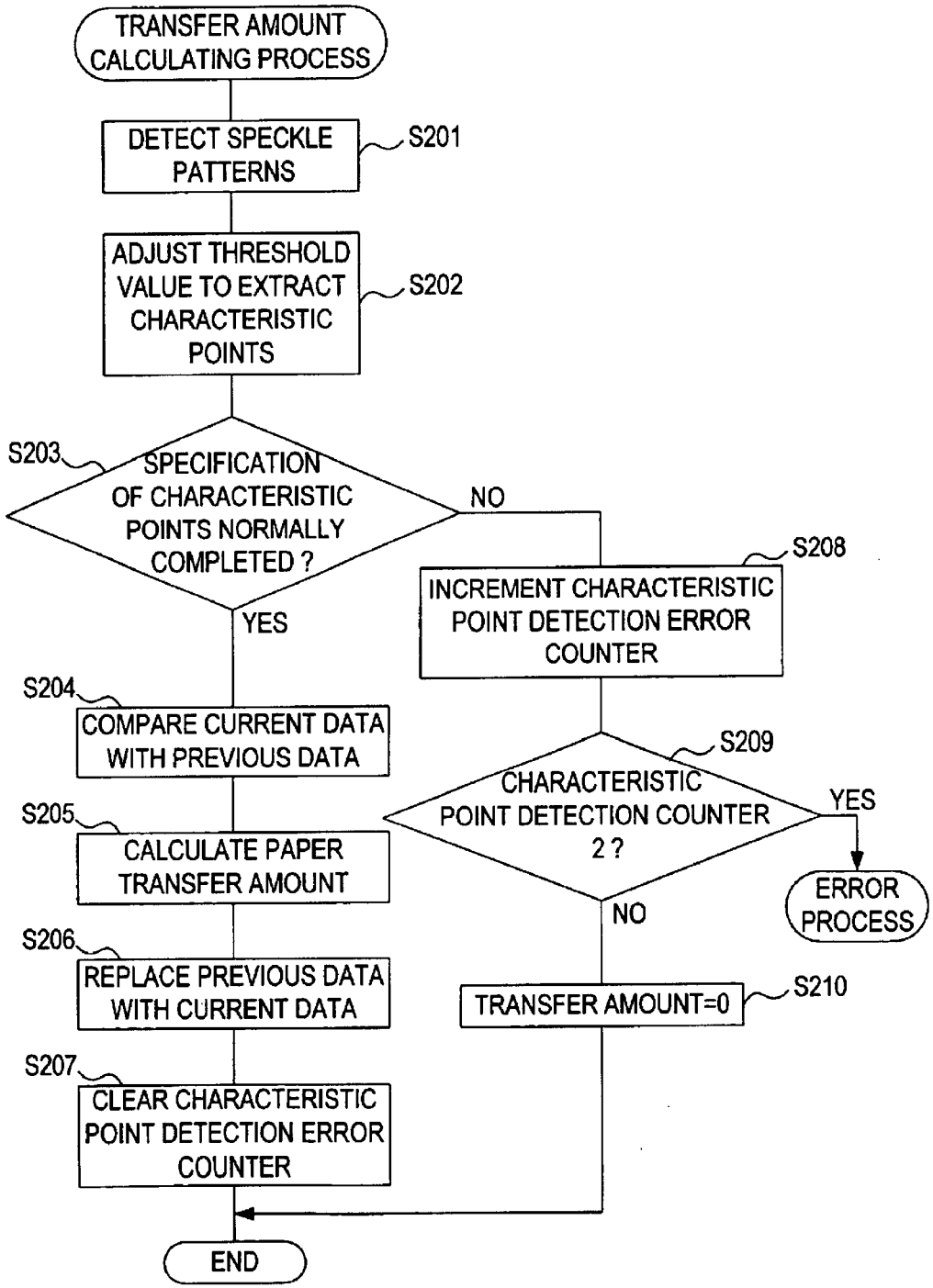
FIG. 8 is a flowchart for explaining transfer amount calculating processes.

The transfer amount calculating process in Step 200 will now be explained in further detail with reference to FIG. 8.

The motion sensor 70 detects the speckle patterns continuously and sends information about the speckle patterns converted into digital signals through the amplifier and the A/D converter 71 to the correlator 54 (S201).

The correlator 54 adjusts the threshold value to extract characteristic points (S202), and specifies several characteristic points (S203).

If the specification of characteristic points is normally completed (S203: YES), the moving direction and the moving amount of the characteristic points are calculated based on the speckle pattern information and the resolution of the photoreceptor by comparison between the previous data and the current data of the characteristic points which move in accordance with the movement of the measuring object (S204). Subsequently, by multiplying the moving amount calculated in S204 by a predetermined correction factor with respect to the actual moving amount of the paper, the transfer amount is calculated (S205). After the current data about the characteristic points is stored so as to replace the previous data about the characteristic points (S206), a characteristic point detection error counter (explained in detail later) is cleared (S207) and the entire process is terminated.

If the specification of characteristic points is not normally completed (S203: NO), for example, if characteristic points cannot be specified in the speckle pattern information in spite of adjusting the threshold value because of the influence of noises, the characteristic point detection counter for counting the number of characteristic points detection errors is incremented (S208).

If the indication of the characteristic point detection counter is more than 2, that is, the characteristic point detection ends up with three consecutive errors (S209: YES), a moving amount detection error is determined and the user is informed of the error so as to perform error handling such as stopping the operation of the device. On the other hand, if the indication of the characteristic point detection counter is equal to or less than 2 (S209: NO), the moving amount is determined 0 without calculating the moving amount (S210) and the process is terminated.

Thus, it is possible to prevent an incorrect moving amount provided by a detection error from being used for input of feedback control.

h) Effects exhibited by the ink jet printer 1 of the present Embodiment 1 will now be explained.

According to the ink jet printer 1, when the transfer amount of paper P as calculated in Step 200 (transfer amount per single pulse time) based on the signals from the motion sensor 70 indicates an abnormal value (when it is determined NO in Step 215), transfer of the paper P is controlled using a preliminarily set prescribed transfer amount instead of the transfer amount of the paper P as calculated in Step 200.

In other words, the preliminarily set prescribed transfer amount is set to be the paper transfer amount control value (Step 290), and a timing (time section) for printing is defined on the basis of the paper transfer amount control value (Steps 230 and 240)

Accordingly, the ink jet printer 1 of Embodiment 1 is capable of eliminating cases in which intervals of printing become largely irregular even when the transfer amount of the paper P cannot be accurately measured by using the motion sensor 70.

(Embodiment 2)

a) The structure of an ink jet printer according to Embodiment 2 is, in general, similar to that of the ink jet printer 1 of the above Embodiment 1.

b) Actions of the ink jet printer of Embodiment 2 will now be explained.

The actions of the ink jet printer of Embodiment 2 are essentially the same as those of the ink jet printer 1 of Embodiment 1.

However, normality/abnormality of the transfer amount of the paper P as calculated in Step 200 is determined in Step 210 of Embodiment 2 on the basis of whether or not a correlation value of paper position signals is equal to or higher than a specified reference correlation value (execution of correlation value determining means).

More particularly, the waveform of a digital signal as stored in the RAM 53 immediately prior to the transfer of the paper P in Step 170 is compared to the waveform of a digital signal stored in the RAM 53 immediately after the transfer of the paper P in Step 170 in the correlator 54 for calculating a correlation value, and it is determined in a determining portion 60 whether or not the correlation value is equal to or higher than the specified reference correlation value.

When the calculated correlation value is equal to or higher than the reference correlation value, it is determined that the digital signal output from the motion sensor 70 is reliable, and it is determined that the transfer amount of the paper P as calculated in Step 200 is normal.

On the other hand, when the calculated correlation value is lower than the reference correlation value, it is determined that the digital signal output from the motion sensor 70 is not reliable, and it is determined that the transfer amount of the paper P as calculated in Step 200 is abnormal.

When it is determined in Step 200 that the calculated transfer amount of the paper P is normal, the program proceeds to Step 220, while if it is determined to be abnormal, the program proceeds to Step 290.

c) The ink jet printer of the present Embodiment 2 exhibits effects similar to those of the ink jet printer 1 of Embodiment 1.

(Embodiment 3)

a) The structure of an ink jet printer according to Embodiment 3 is, in general, similar to that of the ink jet printer 1 of the above Embodiment 1.

b) Actions of the ink jet printer of Embodiment 3 will now be explained with reference to FIG. 9. Description about the actions similar to Embodiment 1 or Embodiment 2 is simplified.

In Step 400, a printing start signal and printing data are input from the external electronic device to the controller 50 through the interface for communication and are stored in the RAM 53.

In Step 410, the paper P is taken out from the paper feed cassette 11 and is transferred along the transfer path 4.

Upon detection of a tip end of the paper P by the paper end detecting sensor 42 in Step 420, in Step 430, the paper feed roller 14 further rotates by a specified amount so that the tip end of the paper P hits against a nip of the first transfer roller 21 and the follower roller 22 to cause so-called resist actions; thereafter, upon rotational driving of the feed motor 62 in the reverse direction, the first transfer roller 21, which has so far been rotating in a counter-clockwise direction in FIGS. 1 and 2, starts to rotate in a clockwise direction by a specified amount (prescribed amount for tip end) to transfer the paper P until the head of a printing area of the paper P is placed right under the printing head 36 of the print mechanism 30. Thereafter, the first transfer roller 21 and the paper P temporarily stop.

In Step 440, printing is performed by the length of the printing head 36 using the print mechanism 30 with the paper P in a suspended condition.

In Step 450, the motion sensor 70 is initialized and values (after-mentioned counted values and the number of pulses) stored in the RAM 53 as parameters to be used for controlling the transfer of the paper P are reset.

In Step 460, a digital signal detected by the motion sensor 70 is stored in the RAM 53 (execution of paper position signal detecting means).

In Step 470, the paper P is transferred in a downstream direction by driving the feed motor 62 by a single pulse.

In Step 480, it is determined whether the paper end detecting sensor 42 is ON or not (that is, whether the rear end in the transferring direction of the paper P has not yet passed the paper end detecting sensor 42 or already has), and the program proceeds to Step 490 when YES. On the other hand, when NO, the program proceeds to Step 630.

In Step 490, the number of pulses (number of times transfer by a single pulse (Step 470) has been executed since Step 450) is incremented by 1 for updating. It should be noted that the number of pulses is reset in Step 450 as already discussed.

In Step 500, a digital signal detected by the motion sensor 70 is stored in the RAM 53, similarly to the above Step 460 (execution of paper position signal detecting means).

In Step 510, the newest signal and the next newest signal among the digital signals that have been stored in the RAM 53 either in Step 460 or in Step 500 are used for performing calculation in the correlator 54 and the transfer amount by which the paper P has been transferred in the transferring direction in Step 470 is calculated (execution of paper transfer amount calculating means). The calculation of transfer amount in Step 510 includes similar processes to those in Step 200 (S201-S210).

In Step 520, the transfer amount of the paper P as calculated in Step 510 is added to the counted value (accumulated value of the paper transfer amount since Step 450) for updating the counted value. It should be noted the counted value is reset in Step 450 as already discussed.

In Step 530, it is determined whether or not the number of pulses updated in Step 490 has reached a specified number of pulses for determination. The specified number of pulses for determination is set to a number which is smaller than the number of pulses for transfer (a prescribed number of pulses) necessary to reach the next position for printing, i.e. the number of pulses corresponding to a prescribed amount for line break. Specifically, the specified number of pulses for determination is set to a number which is half (50%) of the prescribed number of pulses. When it is determined YES, the program proceeds to Step 540 while it proceeds to Step 590 when NO.

In Step 540, it is determined whether or not the counted value updated in Step 520 is equal to or larger than a specified lower limit for the counted value (execution of accumulated transfer amount determining means). When it is determined NO, the program proceeds to Step 550, while when it is determined YES, the program proceeds to Step 610.

In Step 550, the paper P is transferred by an amount calculated by subtracting the number of pulses at the present point of time from the prescribed number of pulses (corresponding to the prescribed amount for line break), and the program proceeds to Step 560.

In other words, the number of pulses by which the paper P has been driven since Step 450 is made equal to the prescribed number of pulses. By this, even if the calculated transfer amount is outside of the normal range since the contrast of speckle patterns is degraded depending on types or conditions of the paper, printing can be continued on the presumption that the paper is being transferred with an acceptable accuracy instead of being stopped.

In Step 560, printing corresponding to a single line is performed. It is the head portion of the printing data which have not been printed yet that is printed in this Step 560.

In Step 570, it is determined whether any printing data that have not been printed yet are present or not. If YES, the program proceeds to Step 450 while it proceeds to Step 580 if NO.

In Step 580, the first transfer roller 21 and the second transfer roller 25 are driven by the feed motor 62 for discharging paper P to the downstream side of the transfer path 4.

On the other hand, when it is determined NO in Step 530, the program proceeds to Step 590. In Step 590, it is determined whether or not the counted value updated in Step 520 has reached a specified counted value for determination (determining distance). The specified counted value for determination (determining distance) is set to a value smaller than the transfer amount corresponding to the prescribed amount for line break. Specifically, the specified counted value for determination is set to a value which is half (50%) of the prescribed amount. When it is determined YES, the program proceeds to Step 600, while when it is determined NO, the program proceeds to Step 470.

In Step 600, it is determined whether or not the number of pulses updated in Step 490 is equal to or larger than a specified lower limit number of pulses (execution of accumulated time determining means). When it is determined NO, the program proceeds to Step 550, while when it is determined YES, the program proceeds to Step 620. In Step 550 the paper P is transferred by an amount calculated by subtracting the number of pulses updated in Step 490 from the prescribed number of pulses (the number of pulses for transfer corresponding to the prescribed amount for line break), and the program proceeds to Step 560.

In Steps 610 and 620, it is respectively determined whether or not the counted value has reached a prescribed amount for line break, and if YES, the program proceeds to Step 560, while to Step 470 if NO.

Further, when it is determined NO in Step 480, the program proceeds to Step 630 for executing rear end portion printing processes. The rear end portion printing processes are similar to the rear end portion printing processes of Embodiment 1 (Step 280).

c) Effects exhibited by the ink jet printer of the present Embodiment 3 will now be explained.

According to the ink jet printer of Embodiment 3, it is determined NO in Step 540 when the transfer amount of the paper P is, for some reasons, detected to be smaller than it actually is and, as a result, the counted value (accumulated value of paper transfer amount control values) at the number of pulses for determination (i.e. determining time) is abnormally small.

It is also determined NO in Step 600 when the transfer amount of the paper P is, for some reasons, detected to be larger than it actually is and, as a result, the number of pulses at the counted value for determination (i.e. determining distance), which corresponds to the accumulated value of transfer time of the paper P, is abnormally small.

In other words, the ink jet printer of the present Embodiment 3 is capable of determining that the transfer amount of the paper P as measured by using the motion sensor 70 is inaccurate and that the counted value is accordingly inaccurate.

When it is determined that the counted value is inaccurate, no processes of determining a timing for printing is performed on the basis of the counted value (processes performed when it is determined YES in Step 610 or Step 620), but the transfer time for the paper P between one printing process and another is instead defined to be the time corresponding to the preliminarily set prescribed number of pulses in Step 550.

With this arrangement, it is possible to eliminate cases in which intervals between printings become largely irregular even when the transfer amount of the paper P obtained by the motion sensor 70 is inaccurate.

(Embodiment 4)

a) The structure of an ink jet printer according to Embodiment 4 is similar to that of the ink jet printer 1 of the above Embodiment 1.

b) Actions of the ink jet printer of Embodiment 4 will now be explained.

The actions of the ink jet printer are, in general, similar to the actions of the ink jet printer of Embodiment 3.

However, the ink jet printer determines, similarly to the ink jet printer 1 of Embodiment 1, normality/abnormality of the transfer amount of the paper P in a single pulse time, and the paper transfer amount control value is defined on the basis of the obtained result. Processes for defining printing timings are then performed on the basis of the paper transfer amount control value.

Figure 11:
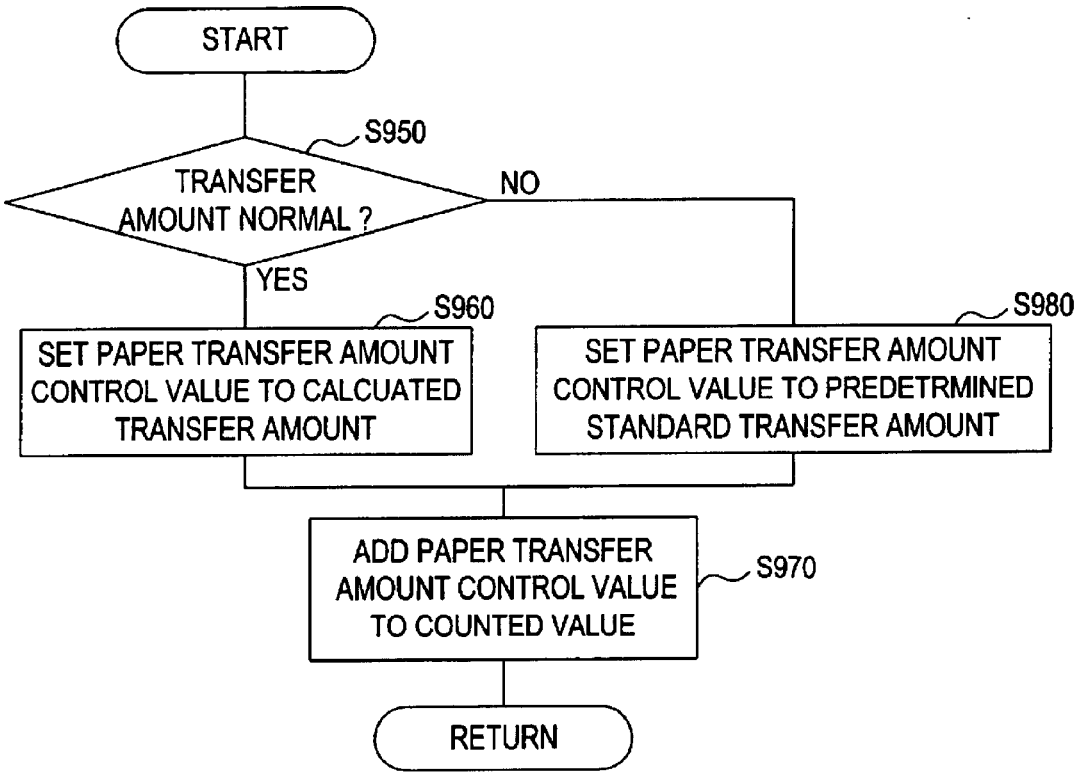
FIG. 11 is a flowchart illustrating the counted value updating processes performed by the ink jet printer of Embodiment 4.

Detailed explanations will now follow with reference to FIGS. 10 and 11. It should be noted that description of the processes similar to those of Embodiment 3 will be simplified.

In Step 700, a printing start signal and printing data are input from the external electronic device through the interface for communication into the controller 50 and are stored in the RAM 53.

In Step 710, the paper P is taken out from the paper feed cassette 11 and is transferred along the transfer path 4.

When a tip end of the paper P is detected by the paper end detecting sensor 42 in Step 720, the paper feed roller 14 further rotates by a specified amount in Step 730 so that the tip end of the paper P hits against a nip of the first transfer roller 21 and the follower roller 22 to cause-so-called resist actions; thereafter, upon rotational driving of the feed motor 62 in a reverse direction, the first transfer roller 21, which has so far been rotating in a counter-clockwise direction in FIGS. 1 and 2, starts to rotate in a clockwise direction by a specified amount (prescribed amount for tip end) to transfer the paper E until a top of a printing region of the paper P is placed right under the printing head 36 of the print mechanism 30. Thereafter, the first transfer roller 21 and the paper P temporarily stop.

In Step 740, printing is performed by the length of the printing head 36 using the print mechanism 80 with the paper P in a suspended condition.

In Step 750, values (after-mentioned counted values and the number of pulses) stored in the RAM 53 as parameters to be used for controlling the transfer of the paper P are reset.

In Step 760, a digital signal detected by the motion sensor 70 is stored in the RAM 53 (execution of paper position signal detecting means).

In Step 770, the paper P is transferred in a downstream direction by driving the feed motor 62 by a single pulse, and the idle roller is rotated by a specified amount as well accompanying the transfer of the paper P.

In Step 780, it is determined whether the paper end detecting sensor 42 is ON or not (that is, whether the rear end in the transferring direction of the paper P has not yet passed the paper end detecting sensor 42 or already has), and the program proceeds to Step 790 when YES. On the other hand, when NO, the program proceeds to Step 920.

In Step 790, the number of pulses (number of times transfer by a single pulse (Step 770) has been executed since Step 750) is incremented by 1 for updating. It should be noted that the number of pulses is reset in Step 750.

In Step 800, a digital signal detected by the motion sensor 70 is stored in the RAM 53, similarly to the above Step 760 (execution of paper position signal detecting means).

In Step 810, the newest signal and the next newest signal among the digital signals that have been stored in the RAM 53 either in Step 760 or in Step 800 are used for performing calculation in the correlator 54 and the transfer amount by which the paper P has been transferred in the transferring direction in Step 790 is calculated (execution of paper transfer amount calculating means). The calculation of transfer amount in Step 810 includes similar processes to those in Step 200 (S201-S210).

In Step 815, the transfer amount of the paper P as calculated in Step 810 is used for executing updating processes of the counted value.

The counted value updating processes will now be explained with reference to FIG. 11.

In Step 950, it is determined whether or not the transfer amount of the paper P as calculated in Step 810 is within a specified normal range (execution of paper transfer amount determining means). When it is determined YES, the program proceeds to Step 960 while it proceeds to Step 980 when NO.

In Step 960, a paper transfer amount control value is set to the transfer amount of the paper P as calculated in Step 810.

In Step 970, the paper transfer amount control value is added to the counted value at the time the Step 970 was executed the last time for updating the counted value.

On the other hand, when it is determined NO in Step 950, the program proceeds to Step 980.

In Step 980, the paper transfer amount control value is set to a predetermined standard transfer amount, and the program proceeds to Step 970.

After execution of Step 970, the program returns to the printing process in Step 820.

In Step 820, it is determined whether or not the number of pulses updated in Step 790 has reached a specified number of pulses for determination (i.e. determining time). When it is determined YES, the program proceeds to Step 830, while it proceeds to Step 880 when NO.

In Step 830, it is determined whether or not the counted value updated by the counted value updating process in Step 815 is equal to or larger than a specified lower limit for the counted value (execution of accumulated transfer amount determining means). When it is determined NO, the program proceeds to Step 840, while when it is determined YES, the program proceeds to Step 900.

In Step 840, the paper P is transferred by an amount calculated by subtracting the number of pulses at the present point of time from a prescribed number of pulses, and the program proceeds to Step 850.

In Step 850, printing corresponding to a single line is performed. It is the head portion of the printing data which have not been printed yet that is printed in this Step 850.

In Step 860, it is determined whether any printing data that have not been printed yet are present or not. If YES, the program proceeds to Step 750 while it proceeds to Step 870 if NO.

In Step 870, the first transfer roller 21 and the second transfer roller 25 are driven by the feed motor 62 for discharging paper P to the downstream side of the transfer path 4.

On the other hand, when it is determined NO in Step 820, the program proceeds to Step 880. In Step 880, it is determined whether or not the counted value updated by the counted value updating process in Step 815 has reached a specified counted value for determination (determining distance). When it is determined YES, the program proceeds to Step 890, while when it is determined NO, the program proceeds to Step 770.

In Step 890, it is determined whether or not the number of pulses updated in Step 790 is equal to or larger than a specified lower limit number of pulses (lower limit time) (execution of accumulated time determining means). When it is determined NO, the program proceeds to Step 840, while when it is determined YES, the program proceeds to Step 910.

In Steps 900 and 910, it is respectively determined whether or not the counted value has reached a prescribed amount for line break, and if YES, the program proceeds to Step 850, while to Step 770 if NO.

Further, when it is determined NO in Step 780, the program proceeds to Step 920 for executing rear end portion printing processes. The rear end portion printing processes are similar to the rear end portion printing processes of Embodiment 1 (Step 280).

c) Effects exhibited by the ink jet printer of the present Embodiment 4 will now be explained.

(1) According to the ink jet printer of Embodiment 4, when the transfer amount of the paper P per single pulse time (transfer amount calculated in Step 810) indicates an abnormal value (i.e. when it is determined NO by the counted value updating process in Step 950), transfer of the paper P is controlled using a preliminarily set prescribed transfer amount instead of the transfer amount of the paper P as calculated in Step 810.

In other words, the preliminarily set prescribed transfer amount is used to update the counted value (Step 980, Step 970), and a timing for printing is defined on the basis of the updated counted value (the processes in Step 820 onward).

Accordingly, the ink jet printer of Embodiment 4 is capable of eliminating cases in which intervals of printing become largely irregular even when the transfer amount of the paper P per single pulse time measured by the motion sensor 70 is inaccurate.

(2) According to the ink jet printer of Embodiment 4, it is determined NO in Step 830 when the transfer amount of the paper P is, for some reasons, detected to be smaller than it actually is and, as a result, the counted value (accumulated value of paper transfer amount control values) at the number of pulses for determination (i.e. determining time) is abnormally small.

It is also determined NO in Step 890 when the transfer amount of the paper P is, for some reasons, detected to be larger than it actually is and, as a result, the number of pulses at the counted value for determination (i.e. determining distance), which corresponds to the accumulated value of transfer time of the paper P, is abnormally small.

In other words, the ink jet printer of the present Embodiment 4 is capable of determining that the transfer amount of the paper P as measured by using the motion sensor 70 is inaccurate and that the counted value is accordingly inaccurate.

When it is determined that the counted value is inaccurate, no processes of determining a timing for printing is performed on the basis of the counted value (processes performed when it is determined YES in Step 900 or Step 910), but the transfer time for the paper P between one printing process and another is instead defined to be the time corresponding to the preliminarily set prescribed number of pulses in Step 840.

With this arrangement, it is possible to eliminate cases in which intervals between printings become largely irregular even when the transfer amount of the paper P obtained by the motion sensor 70 is inaccurate.

(3) Since the ink jet printer of Embodiment 4 can provide both of the above-described effects (1) and (2), it is possible to perform printing (image forming) in an even more accurate manner.

What is claimed is:

1. An image forming device, comprising:

paper position signal detecting means for irradiating coherent rays of light onto a surface that moves accompanying transfer of paper and for receiving reflected light of the rays of light to generate paper position signals related to positions of the paper;

paper transfer amount calculating means for calculating at each specified unit of driving time, through chronological comparison of the paper position signals, a paper transfer amount corresponding to the distance by which the paper has been transferred during each unit of driving time;

paper transferring means for transferring the paper by using a driving source at a specified driving speed at each specified time section;

paper transfer amount determining means for determining whether or not the calculated paper transfer amount is within a specified normal range at the each unit of driving time;

paper transfer amount control value setting means for setting the calculated paper transfer amount as a paper transfer amount control value for a corresponding unit of driving time when it has been determined by the paper transfer amount determining means that the calculated paper transfer amount is within the normal range and for setting a predetermined standard transfer amount as the paper transfer amount control value for a corresponding unit of driving time when it has been determined that the calculated paper transfer amount is outside of the normal range; and time section setting means for setting a time section on the basis of an accumulated value of the paper transfer amount control values.

2. The image forming device as claimed in claim 1, wherein the time section setting means defines a time at which the accumulated value of the transfer amount control values from the starting point of the time section reaches a prescribed section distance as a terminating point of the time section.

3. The image forming device as claimed in claim 1 further comprising:

accumulated transfer amount determining means for determining whether or not the accumulated value of the paper transfer amount control value from the starting point of the time section is smaller than a specified lower limit distance at a point of time at which an accumulated value of driving time of the driving source from the starting point of the time section has reached a specified determining time; and time section setting means for defining, when it has been determined by the accumulated transfer amount determining means that the accumulated value of the paper transfer amount control values is smaller than the specified lower limit distance, a point of time at which the transfer amount of the paper calculated from the starting point of the time section on the basis that the transfer amount per unit driving time is the standard transfer amount has reached a prescribed section distance as a terminating point of the time section, otherwise defining a point of time at which the accumulated value of the paper transfer amount control values from the starting point of the time section has reached the prescribed section distance as the terminating point of the time section.

4. The image forming device as claimed in claim 1, further comprising:

accumulated time determining means for determining whether or not an accumulated driving time of the driving source from the starting point of the time section is shorter than a specified lower limit time when the accumulated value of the paper transfer amount control values from the starting point of the time section has reached a specified determining distance; and time section setting means for defining, when it has been determined by the accumulated time determining means that the accumulated driving time of the driving source is shorter than the specified lower limit time, a point of time at which the transfer amount of the paper, calculated from the starting point of the time section on the basis that the transfer amount per unit driving time is the standard transfer amount, has reached a prescribed section distance as the terminating point of the time section, otherwise defining a point of time at which the accumulated value of the paper transfer amount control values from the starting point of the time section has reached the prescribed section distance as the terminating point of the time section.

5. The image forming device as claimed in claim 3, wherein the determining time is shorter than a time in which the transfer amount of paper calculated on the basis that the transfer amount of paper per unit driving time is the standard transfer amount, reaches the prescribed section distance.

6. The image forming device as claimed in claim 4, wherein the determining distance is shorter than the prescribed section distance.

7. The image forming device as claimed in claim 1, wherein the time section is a time interval for forming an image on the paper.

8. The image forming device as claimed in claim 1, wherein the transfer amount of paper is calculated by the paper transfer amount calculating means on the basis of speckle patterns included in the reflected light.

9. The image forming device as claimed in claim 1, wherein a stepping motor is provided as the driving source, and wherein the number of driving pulses of the stepping motor corresponds to the accumulated driving time.

10. An image forming device, comprising:

paper position signal detecting means for irradiating coherent rays of light onto a surface that moves accompanying transfer of paper and for receiving reflected light of the rays of light to generate paper position signals related to positions of the paper;

paper transfer amount calculating means for calculating at each specified unit of driving time, through chronological comparison of the paper position signals, a paper transfer amount corresponding to the distance by which the paper has been transferred during each unit of driving time;

paper transferring means for transferring the paper by using a driving source at a specified driving speed at each specified time section;

correlation value determining means for determining whether or not a correlation value of the paper position signals, which have been compared for calculating the paper transfer amount by the paper transfer amount calculating means, is equal to or higher than a specified reference correlation value;

paper transfer amount control value setting means for setting the calculated paper transfer amount as the paper transfer amount control value for a corresponding unit of driving time when it has been determined by the correlation value determining means that the correlation value is equal to or higher than the reference correlation value and for setting a predetermined standard transfer amount as the paper transfer amount control value for a corresponding unit of driving time when it has been determined that the correlation value is lower than the reference correlation value; and time section setting means for setting a time section on the basis of an accumulated value of the paper transfer amount control values.

11. The image forming device as claimed in claim 10, wherein the time section setting means defines a time at which the accumulated value of the transfer amount control values from the starting point of the time section reaches a prescribed section distance as a terminating point of the time section.

12. The image forming device as claimed in claim 10 further comprising:

accumulated transfer amount determining means for determining whether or not the accumulated value of the paper transfer amount control value from the starting point of the time section is smaller than a specified lower limit distance at a point of time at which an accumulated value of driving time of the driving source from the starting point of the time section has reached a specified determining time; and time section setting means for defining, when it has been determined by the accumulated transfer amount determining means that the accumulated value of the paper transfer amount control values is smaller than the specified lower limit distance, a point of time at which the transfer amount of the paper, calculated from the starting point of the time section on the basis that the transfer amount per unit driving time is the standard transfer amount, has reached a prescribed section distance as a terminating point of the time section, otherwise defining a point of time at which the accumulated value of the paper transfer amount control values from the starting point of the time section has reached the prescribed section distance as the terminating point of the time section.

13. The image forming device as claimed in claim 10, further comprising:

accumulated time determining means for determining whether or not an accumulated driving time of the driving source from the starting point of the time section is shorter than a specified lower limit time when the accumulated value of the paper transfer amount control values from the starting point of the time section has reached a specified determining distance; and time section setting means for defining, when it has been determined by the accumulated time determining means that the accumulated driving time of the driving source is shorter than the specified lower limit time, a point of time at which the transfer amount of the paper, calculated from the starting point of the time section on the basis that the transfer amount per unit driving time is the standard transfer amount, has reached a prescribed section distance as the terminating point of the time section, otherwise defining a point of time at which the accumulated value of the paper transfer amount control values from the starting point of the time section has reached the prescribed section distance as the terminating point of the time section.

14. The image forming device as claimed in claim 12, wherein the determining time is shorter than a time in which the transfer amount of paper calculated on the basis that the transfer amount of paper per unit driving time is the standard transfer amount, reaches the prescribed section distance.

15. The image forming device as claimed in claim 13, wherein the determining distance is shorter than the prescribed section distance.

16. The image forming device as claimed in claim 10, wherein the time section is a time interval for forming an image on the paper.

17. The image forming device as claimed in claim 10, wherein the transfer amount of paper is calculated by the paper transfer amount calculating means on the basis of speckle patterns included in the reflected light.

18. The image forming device as claimed in claim 10, wherein a stepping motor is provided as the driving source, and wherein the number of driving pulses of the stepping motor corresponds to the accumulated driving time.

19. An image forming device, comprising:

paper position signal detecting means for irradiating coherent rays of light onto a surface that moves accompanying transfer of paper and for receiving reflected light of the rays of light to generate paper position signals related to positions of the paper;

paper transfer amount calculating means for calculating at each specified unit of driving time, through chronological comparison of the paper position signals, a paper transfer amount corresponding to the distance by which the paper has been transferred during each unit of driving time;

paper transferring means for transferring the paper by using a driving source at a specified driving speed at each specified time section;

accumulated transfer amount determining means for determining whether or not the accumulated value of the calculated paper transfer amount from the starting point of the time section is smaller than a specified lower limit distance when the accumulated value of driving time of the driving source from the starting point of the time section has reached a specified determining time; and time-section-setting-means for defining, when it has been determined by the accumulated transfer amount determining means that the accumulated value of the calculated paper transfer amount is smaller than the specified lower limit distance, a point of time at which the transfer amount of the paper, calculated from the starting point of the time section on the basis that the transfer amount per unit driving time is a predetermined standard transfer amount, has reached a prescribed section distance as a terminating point of the time section, otherwise defining a point of time at which the accumulated value of the calculated paper transfer amount from the starting point of the time section has reached the prescribed section distance as the terminating point of the time section.

20. The image forming device as claimed in claim 19, further comprising:

accumulated time determining means for determining whether or not an accumulated driving time of the driving source from the starting point of the time section is shorter than a specified lower limit time when the accumulated value of the paper transfer amount control values from the starting point of the time section has reached a specified determining distance; and time section setting means for defining, when it has been determined by the accumulated time determining means that the accumulated driving time of the driving source is shorter than the specified lower limit time, a point of time at which the transfer amount of the paper, calculated from the starting point of the time section on the basis that the transfer amount per unit driving time is the standard transfer amount, has reached a prescribed section distance as the terminating point of the time section, otherwise defining a point of time at which the accumulated value of the calculated paper transfer amount from the starting point of the time section has reached the prescribed section distance as the terminating point of the time section.

21. The image forming device as claimed in claim 19, wherein the determining time is shorter than a time in which the transfer amount of paper calculated on the basis that the transfer amount of paper per unit driving time is the standard transfer amount, reaches the prescribed section distance.

22. The image forming device as claimed in claim 20, wherein the determining distance is shorter than the prescribed section distance.

23. The image forming device as claimed in claim 19, wherein the time section is a time interval for forming an image on the paper.

24. The image forming device as claimed in claim 19, wherein the transfer amount of paper it calculated by the paper transfer amount calculating means on the basis of speckle patterns included in the reflected light.

25. The image forming device as claimed in claim 19, wherein a stepping motor is provided as the driving source, and wherein the number of driving pulses of the stepping motor corresponds to the accumulated driving time.

26. An image forming device, comprising:

paper position signal detecting means for irradiating coherent rays of light onto a surface that moves accompanying transfer of paper and for receiving reflected light of the rays of light to generate paper position signals related to positions of the paper;

paper transfer amount calculating means for calculating at each specified unit of driving time, through chronological comparison of the paper position signals, a paper transfer amount corresponding to the distance by which the paper has been transferred during each unit of driving time;

paper transferring means for transferring the paper by using a driving source at a specified driving speed at each specified time section;

accumulated time determining means for determining whether or not an accumulated driving time of the driving source from the starting point of the time section is shorter than a specified lower limit time when the accumulated value of the calculated paper transfer amount from the starting point of the time section has reached a specified determining distance; and time section setting means for defining, when it has been determined by the accumulated time determining means that the accumulated driving time of the driving source is shorter than the specified lower limit time, a point of time at which the transfer amount of the paper, calculated on the basis that the transfer amount per unit driving time is a predetermined standard transfer amount, has reached a prescribed section distance as the terminating point of the time section, otherwise defining a point of time at which the accumulated value of the calculated paper transfer amount from the starting point of the time section has reached the prescribed section distance as the terminating point of the time section.

27. The image forming device as claimed in claim 26, wherein the determining distance is shorter than the prescribed section distance.

28. The image forming device as claimed in claim 26, wherein the time section is a time interval for forming an image on the paper.

29. The image forming device as claimed in claim 26, wherein the transfer amount of paper is calculated by the paper transfer amount calculating means on the basis of speckle patterns included in the reflected light.

30. The image forming device as claimed in claim 26, wherein a stepping motor is provided as the driving source, and wherein the number of driving pulses of the stepping motor corresponds to the accumulated driving time.

* * * * *